US007022922B2

(12) United States Patent
Nowakowski

(10) Patent No.: US 7,022,922 B2
(45) Date of Patent: Apr. 4, 2006

(54) POWER SWITCH WITH A MOBILE CONTACT ELEMENT AND EXTINCTION GAS FLOW THAT MOVE IN AN AXIAL DIRECTION WHEN ACTIVATED

(75) Inventor: Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 36 days.

(21) Appl. No.: 10/495,454

(22) PCT Filed: Oct. 29, 2002

(86) PCT No.: PCT/DE02/04061

§ 371 (c)(1),
(2), (4) Date: May 13, 2004

(87) PCT Pub. No.: WO03/046939

PCT Pub. Date: Jun. 5, 2003

(65) Prior Publication Data

US 2004/0256361 A1 Dec. 23, 2004

(30) Foreign Application Priority Data

Nov. 14, 2001 (DE) ..... 101 56 535

(51) Int. Cl.
*H01H 83/00* (2006.01)

(52) U.S. Cl. ..... 200/12; 218/43; 218/154

(58) Field of Classification Search ..... 218/43–84, 218/154–157

See application file for complete search history.

(56) References Cited

U.S. PATENT DOCUMENTS 3,816,684 A * 6/1974 Y Teijeiro ..... 218/63
3,855,437 A * 12/1974 Goedecke et al. ..... 218/53
4,000,387 A * 12/1976 Milianowicz ..... 218/61
4,230,920 A * 10/1980 Thaler ..... 218/61
4,276,456 A * 6/1981 Cromer et al. ..... 218/59
4,291,208 A * 9/1981 Cromer et al. ..... 218/62
4,328,403 A * 5/1982 Frink et al. ..... 218/60
4,412,115 A * 10/1983 Okuno ..... 218/59
4,426,561 A * 1/1984 Berkebile ..... 218/59
4,471,187 A * 9/1984 Sturzenegger et al. ..... 218/51

FOREIGN PATENT DOCUMENTS

| | | |
|---|---|---|
| DE | 3425946 | 1/1985 |
| DE | 198 52 653 A1 | 5/2000 |
| EP | 0 885 782 A1 | 12/1998 |
| EP | 0 942 610 A2 | 9/1999 |
| EP | 1 081 504 A2 | 3/2001 |
| EP | 1 087 336 A2 | 3/2001 |

* cited by examiner

OTHER PUBLICATIONS

Ernst, H.: Einführung in die digitale Bildverarbeitung, Franzis Verlag München, Seite 81-84, Jul. 23, 1992.

*Primary Examiner*—Richard K. Lee
(74) *Attorney, Agent, or Firm*—Morrison & Foerster LLP

(57) ABSTRACT

The invention relates to a power switch (100) that comprises a contact element (105, 107) mobile in an axial direction and an extinction gas flow that moves in said axial direction when the switch is actuated. Said extinction gas flow is coaxially surrounded by a flow guide device (1, 1*a,b,c*) one surface area of which is provided with at least one discharge opening (10*a,b,c,d,e,f,g,h,i,j,k,l;* 12*a,b,c,d,e,f*) for deflecting at least a part of the extinction gas flow towards a discharge direction, said discharge direction being oriented tangential and substantially at an angle to the axial direction.

8 Claims, 5 Drawing Sheets

POWER SWITCH WITH A MOBILE CONTACT ELEMENT AND EXTINCTION GAS FLOW THAT MOVE IN AN AXIAL DIRECTION WHEN ACTIVATED

CLAIM FOR PRIORITY

This application claims priority to International Application No. PCT/DE02/04061 which was published in the German language on Jun. 5, 2003, and filed in the German language on Nov. 14, 2001, the contents of which are hereby incorporated by reference.

TECHNICAL FIELD OF THE INVENTION

The invention relates to a power breaker, and in particular, to a power breaker having a contact piece and a flow of quenching gas which has at least one outflow opening in an outer surface.

BACKGROUND OF THE INVENTION

Such a power breaker is disclosed, for example, in patent specification DE 199 53 560 C1. This document describes a power breaker whose interrupter unit is arranged within an encapsulating housing. When the interrupter unit of the power breaker effects a disconnection procedure, some of the quenching gas which may be produced is led away from the switching path there within a hollow contact tube. At the end of the hollow contact tube, which is remote from the switching path, the contact tube has outlet openings from which the quenching gas emerges. The quenching gas emerges into an area which is delimited by a flow-deflecting device. The flow-deflecting device there is essentially cylindrical and has outflow openings in its outer surface. These outflow openings make it possible for the quenching gas to emerge from the area which is delimited by the flow-deflecting device, and to flow out into the volume which surrounds the interrupter unit of the power breaker and is filled with insulating gas.

In order to deflect the quenching gas emerging from the outflow openings in a determined discharge direction, the outflow openings are provided with deflecting covers. These deflecting covers deflect the emerging quenching gas in an axial direction of the interrupter unit. This deflection is necessary in order to prevent the quenching gas from flowing directly into the encapsulating housing. In the event of the quenching gas flowing directly into the encapsulating housing, there would be a risk of the gas insulation being weakened.

It is technically complex in terms of design to provide the outflow openings with deflecting covers, since the deflecting covers are provided individually for each outflow opening and each deflecting cover needs to be fixed individually to the flow-deflecting device. Owing to the relatively complicated arrangement of outflow openings and deflecting covers in relation to one another, there is also no simple production method, for example a casting method, for an arrangement such as this.

SUMMARY OF THE INVENTION

The invention relates to a power breaker having a contact piece which can move in an axial direction and having a flow of quenching gas which, in the event of the breaker operating, moves in the axial direction and which is coaxially surrounded by a flow-deflecting device, which has at least one outflow opening in an outer surface for the purpose of deflecting at least some of the flow of quenching gas in an outflow direction.

In the invention, a power breaker of the type mentioned initially is enabled by allowing the outflow direction to be aligned tangentially with respect to the outer surface and essentially transversely to the axial direction.

A tangential outflow direction with respect to the outer surface extends the path available for the discharge flow. If the outer surface of the flow-deflecting device is complex, uneven and cracked, an appropriate outer boundary needs to be defined for the purpose of determining the tangential direction, in order to establish the correspondingly favorable tangential direction. A tangential direction may also be understood as meaning directions which deviate from a mathematically precise tangent by up to 45° within the azimuth plane. Given corresponding dimensions, the use of deflecting covers which are provided for the outflow openings is not necessary. This reduces the number of components required and, in addition to simplified deflection of the quenching gas, thus also reduces the production costs. Owing to the simplified design, it is now also possible to use simple casting techniques for producing the flow-deflecting device. Milling, drilling or another suitable technique may be used for forming the outflow openings in the outer surface. In addition to the simplified deflection of the quenching gas, it is also possible for the quenching gas to be swirled more effectively.

In one embodiment, provision may also be made for two or more outflow openings to be associated with one another whose respective outflow directions intersect one another.

If the outflow directions of two or more outflow openings which are associated with one another intersect one other, the quenching gas being discharged is swirled and cooled. This swirling, for example, intensively mixes the contaminated quenching gas with fresh insulating gas. Additional swirling devices are thus not required. At the same time, such swirling prevents the gas insulation of the breaker from being weakened, as is possible.

A further advantageous embodiment may provide for the flow-deflecting device to have a protuberance and/or a depression on the outer surface, the outflow opening(s) being arranged on the flanks of said protuberance and/or depression.

If the outflow openings are provided with protuberances and/or depressions, it is thus possible in a simple manner to arrange the discharge directions of the individual outflow openings in a favorable manner. Furthermore, when protuberances are arranged on the flow-deflecting device, the area which is delimited by the flow-deflecting device is increased. This makes it possible to cool the hot quenching gas more effectively when it is still within the interrupter unit of the power breaker.

In another embodiment, provision may advantageously be made for the outflow direction(s) to be arranged perpendicular to the outer surface region immediately surrounding the outflow opening(s).

An embodiment such as this has a favorable influence on the guiding action of the outflow openings. It is thus sufficient, in an embodiment such as this, to use drilling or milling, for example, to form the outflow openings in the flow-deflecting device, and to dispense with additional arrangements for improving the guiding action (for example nozzles).

Provision may further be made in an advantageous embodiment for the protuberance(s) and/or the depression(s) to extend essentially in the axial direction in the manner of a web or channel.

If the web- or channel-like protuberances or depressions extend axially, there are advantageous possibilities for arranging the outflow openings along axially extending lateral surfaces of the protuberances or depressions. The longitudinal extent makes it possible to arrange two or more openings next to one another in the axial direction, as a result of which the amount of quenching gas flowing out is advantageously distributed along the axial extent. In addition, provision may be made for the protuberances and/or depressions to also assist the swirling of quenching gas emerging from the outlet openings. In support of this, additional swirling bodies or baffle surfaces may be provided for the outlet openings for the purpose of influencing the flow of quenching gas.

In addition to the embodiments already described, the invention also provides for a power breaker having a contact piece which can move in an axial direction and having a flow of quenching gas which, in the event of the breaker operating, moves in the axial direction and which is coaxially surrounded by a flow-deflecting device, which has a first and a second outflow opening in an outer surface for deflecting at least some of the flow of quenching gas in a first and in a second outflow direction, to be designed such that the first and the second outflow directions are aligned essentially in the axial direction, and the first discharge direction and the second discharge direction intersect one another.

If provision is made for it to be possible for the quenching gas to flow out essentially in an axial direction, it is particularly advantageous if two discharge directions of two outflow openings intersect one another. In the area of intersection between the discharge directions, the flows of quenching gas are swirled intensively with one another and, if appropriate, with cool insulating gas. Furthermore, swirling causes the flow of quenching gas to be curbed once it has emerged from the flow-deflecting device.

One advantageous embodiment may also provide for the flow-deflecting device to have a protuberance and/or a depression on the outer surface, the first and/or the second outflow openings being arranged on the flanks of said protuberance and/or depression.

The arrangement of the outflow openings on the flanks of the protuberances or depressions makes it possible for the first and the second outflow openings to be associated with one another in a favorable manner, such that it is easily possible to achieve a situation in which the outflow directions of the individual outlet openings intersect one another.

In another embodiment, provision may further be made for the first and/or the second outflow directions to be arranged perpendicular to the outer surface regions immediately surrounding the first and/or the second outflow openings.

As already described, in this case too, there are favorable preconditions for the guiding actions of the outflow openings in the case of an arrangement of the outflow openings such as this with respect to the outer surface regions. The emerging quenching gas is formed into a jet and can easily be directed to a certain region. This minimizes the possibility of the jet of quenching gas being scattered unintentionally.

Advantageously, in still another embodiment, provision may also be made for the protuberance(s) and/or the depression(s) to run around the axial direction in the form of a ring and/or in the form of a broken ring.

If the protuberances and/or the depressions are arranged in the form of a ring or in the form of a broken ring, the outer surface of the flow-deflecting device has an uneven structure, as a result of which the quenching gas being discharged in the axial direction is swirled very intensively. The uneven structure may cause the quenching gas to be swirled both within the flow-deflecting device and once it has left the flow-deflecting device.

BRIEF DESCRIPTION OF THE DRAWINGS

The invention will be shown in the drawings below, with reference to exemplary embodiments and described in more detail below.

In the drawings.

DETAILED DESCRIPTION OF THE INVENTION

Figure 1:
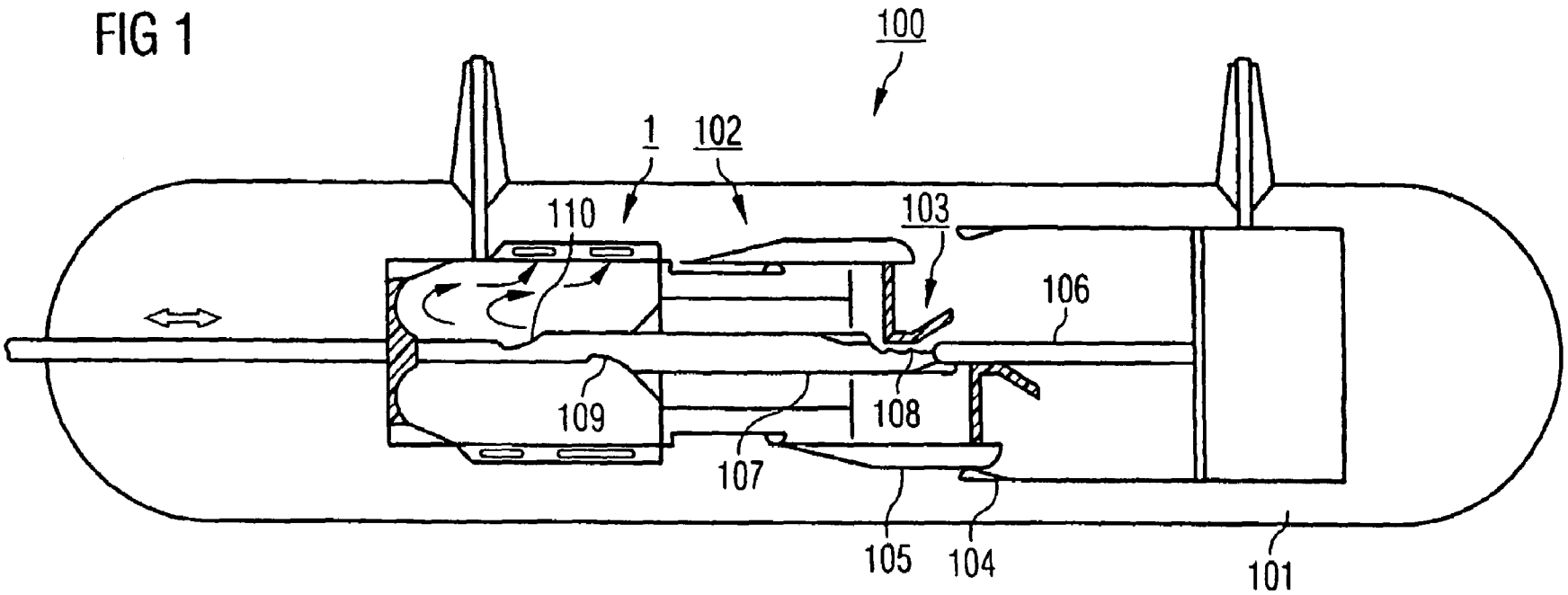
FIG. 1 shows a section through a schematically illustrated compressed gas-insulated power breaker.

The power breaker 100 illustrated in FIG. 1 has an encapsulating housing 101. The encapsulating housing 101 may be made of an electrically conductive material or of an electrically insulating material. An interrupter unit 102 of the power breaker 100 is arranged within the encapsulating housing 101. The encapsulating housing 101 is filled with an insulating gas, for example $SF_6$. The interrupter unit 102 has a contact assembly 103. The contact assembly 103 has a stationary rated current contact 104 and a movable rated current contact 105. A stationary arcing contact 106 and a movable arcing contact 107 are also provided. Both the movable rated current contact 105 and the movable arcing contact 107 can be moved in an axial direction. The lower half of FIG. 1 shows the contact assembly 103 when it is connected; the upper half of FIG. 1 shows the contact assembly 103 during a disconnection process. The movable arcing contact 107 is in the form of a tube such that, during a disconnection process, quenching gas produced by an arc 108 which may have formed can be led away, within the movable arcing contact 107, from the switching path of the contact assembly 103. At the end of the movable arcing contact 107 which is remote from the contact assembly 103, outlet openings 109, 110 are provided, from which the quenching gas can emerge into an area which is surrounded by a flow-deflecting device 1. The arrangement of the flow-deflecting device 1 is not limited to the region of the end of the movable arcing contact 107 which is applied to the contact assembly 103. As an alternative to this, or in addition to this, a flow-deflecting device such as this may also be provided in the region of the stationary rated current contact 104, in order there to deflect the quenching gas being discharged in the direction of said rated current contact 104.

Figure 2:
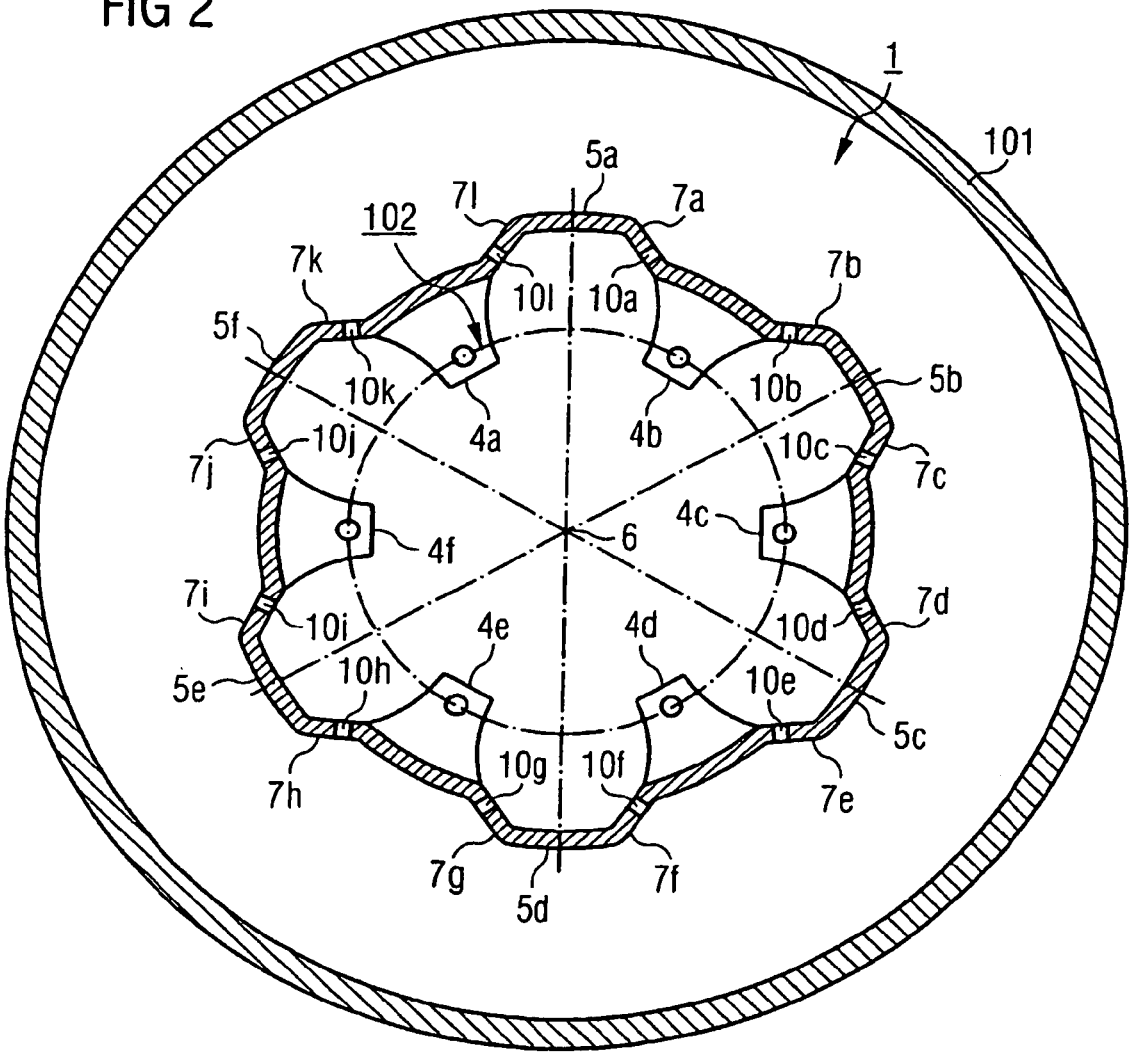
FIG. 2 shows a section through a flow-deflecting device and an encapsulating housing of the compressed gas-insulated power breaker.

FIG. 2 shows a cross section through the flow-deflecting device 1 and the encapsulating housing 101.

Figure 3:
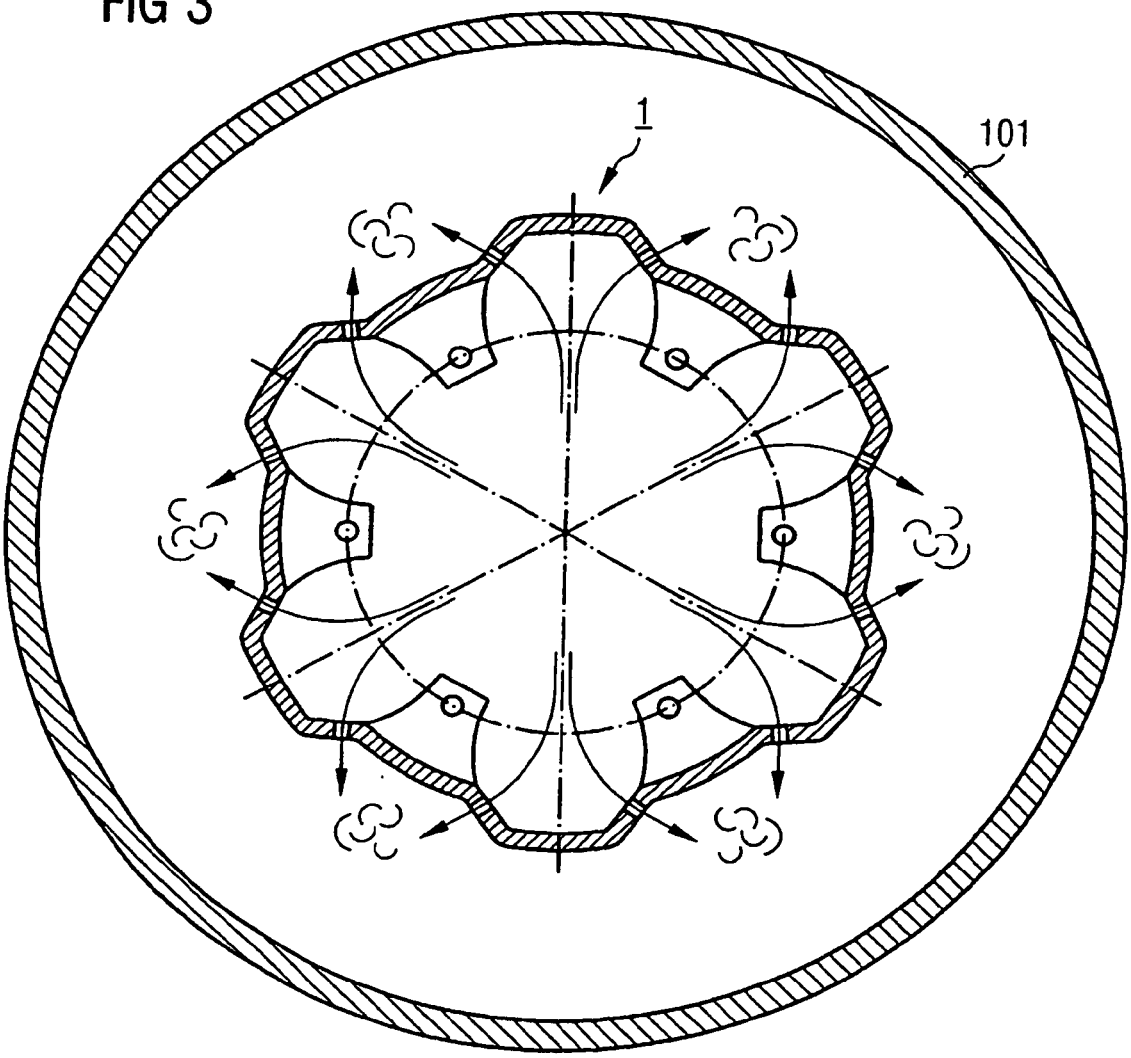
FIG. 3 shows a schematic illustration of the quenching gas being swirled.

The flow-deflecting device 1 has an essentially circular cross section. Two or more lugs 4*a,b,c,d,e,f* are arranged within its interior. The lugs 4*a,b,c,d,e,f* serve the purpose both of mechanically retaining the flow-deflecting device 1 on the interrupter unit 102 and of making electrical contact with the interrupter unit 102. The cylindrical base body of the flow-deflecting device 1 has two or more protuberances 5*a,b,c,d,e,f*. The protuberances 5*a,b,c,d,e,f* are essentially formed by specific sections of the outer surface of the cylindrical base body being extended radially outwards with respect to the longitudinal axis 6 of the cylinder. The contact areas between the original cylinder surface and the regions which have been extended radially outwards are formed by sloping flanks 7*a,b,c,d,e,f,g,h,i,j,k,l*. The sloping flanks 7*a,b,c,d,e,f,g,h,i,j,k,l* each have outflow openings 10*a,b,c,d,e,f,g,h,i,j,k,l* for deflecting at least some of the quenching gas produced in the interrupter unit 102. Each outflow opening 10*a,b,c,d,e,f,g,h,i,j,k,l* deflects a proportion of the quenching gas in a discharge direction. In this case, the discharge directions are each arranged such that they are aligned perpendicular to the respective sloping flanks 7*a,b,c,d,e,f,g,h,i,j,k,l*. The discharge directions of the respective proportions of the quenching gas are symbolized in FIG. 3 by arrows. On the basis of the selected position of the outflow openings 10*a,b,c,d,e,f,g,h,i,j,k,l* with respect to one another, each of the discharge directions of two opposing outflow openings of adjacent protuberances intersect one another. This results in the quenching gas being mixed in a favorable manner once it has passed through the respective outflow openings. This mixing is shown schematically in FIG. 3.

Figure 4:
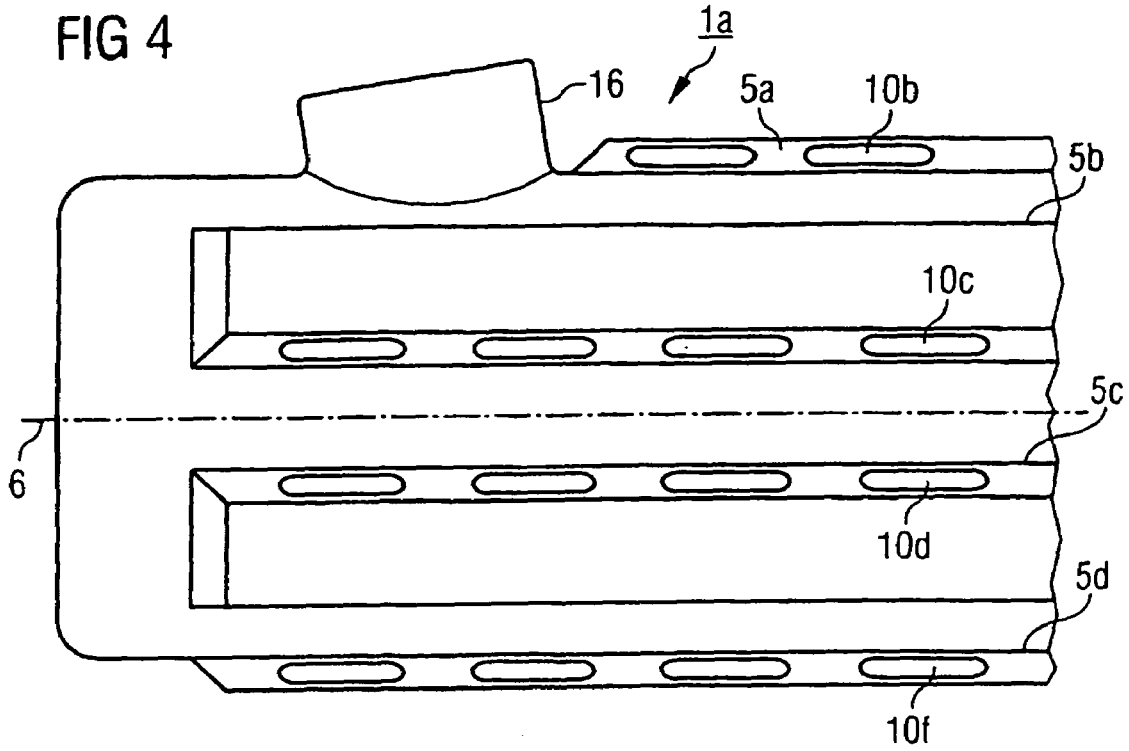
FIG. 4 shows a side view of a first embodiment of a flow-deflecting device.
Figure 5:
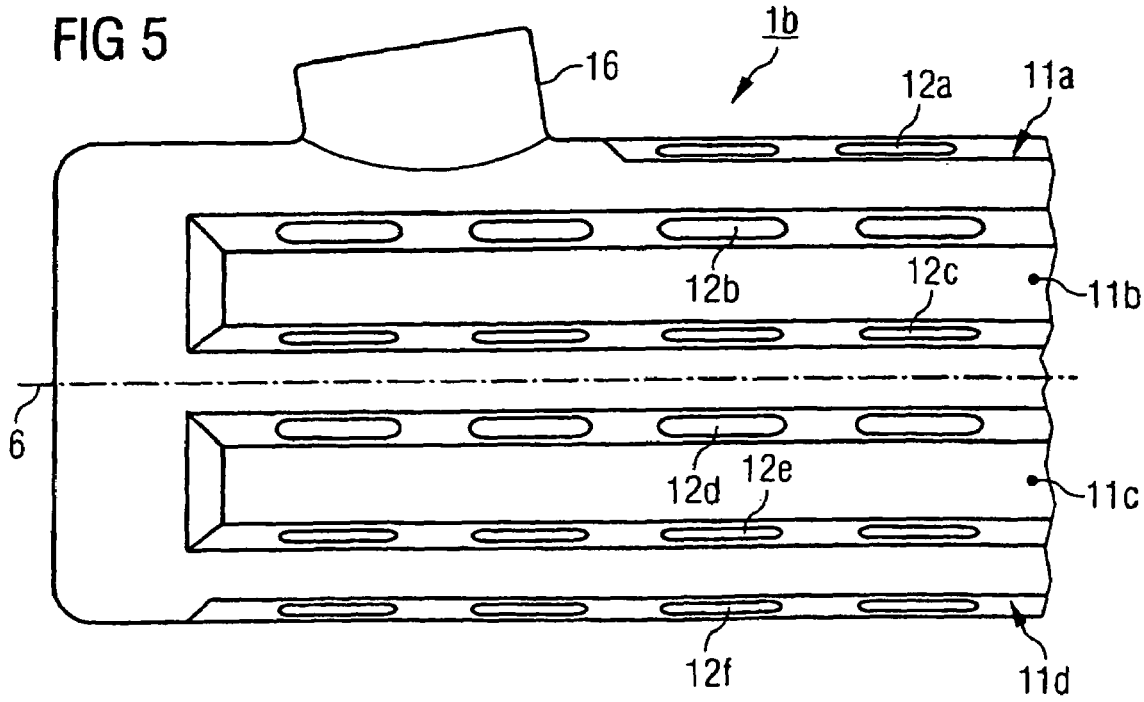
FIG. 5 shows the side view of a second embodiment of a flow-deflecting device.
Figure 6:
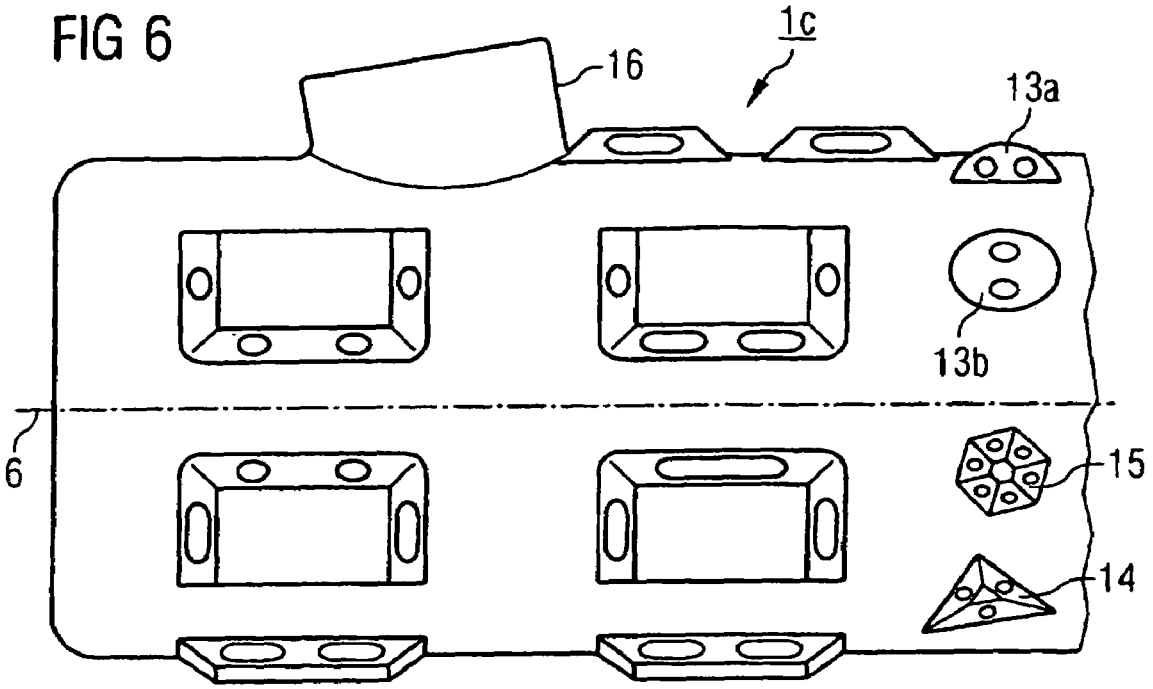
FIG. 6 shows the side view of a third embodiment of a flow-deflecting device.

A first variant illustrated in FIG. 4 of a flow-deflecting device 1*a* shows a side view. Arrangements having the same function are provided with the same reference numerals in the figures. A connecting nozzle 16 is integrally formed on the first variant of the flow-deflecting device 1*a* for connection to an electrical conductor. The first variant of the flow-deflecting device 1*a* has a cylindrical basic shape, on the outer surface of which two or more protuberances 5*a,b,c,d* are arranged. The protuberances 5*a,b,c,d* extend in the manner of webs along the axial direction. One end of the first variant of the flow-deflecting device 1*a* is closed, as in all variants described, in order to allow the quenching gas blown into the first variant of the flow-deflecting device 1*a* to be discharged through outflow openings 10*b,c,d,f* arranged in the protuberances 5*a,b,c,d*. In the first variant of the flow-deflecting device 1*a*, the protuberances 5*a,b,c,d* have an external shape which is in the form of a truncated pyramid. Two or more outflow openings 10*b,c,d,f* are arranged in the lateral surfaces (flanks) of the truncated pyramids. The outflow openings 10*b,c,d,f* are in the form of slots in the first variant of the flow-deflecting device 1*a*. Provision may be made for in each case two outflow openings 10*c,d* of two adjacent protuberances 5*b,c* to each be provided directly opposite one another, and for the discharge directions of the in each case directly associated discharge openings 10*c,d* to intersect one another. The second variant illustrated in FIG. 5 of a flow-deflecting device 1*b* has two or more depressions 11*a,b,c,d* on its cylindrical outer surface. Further outflow openings 12*a,b,c,d,e,f* are arranged in the flanks of the depressions 11*a,b,c,d*. The discharge directions of the outflow openings 12*d,e* lying directly opposite one another in a depression 11*c* are aligned such that they intersect one another. The third variant illustrated in FIG. 6 of a flow-deflecting device 1*c* shows, by way of example, further possible refinements of the protuberances or depressions. The protuberances or depressions may be arranged, for example, in a large number of different forms on the outer surface of a flow-deflecting device. The respective outflow openings may in this case be formed in widely differing ways, for example they may be circular, oval or have other suitable shapes, and may be, for example, in the form of a perpendicular or sloping drilled/milled hole. If the drilled/milled holes are introduced at an obtuse or an acute angle in the outer surface of a flow-deflecting device, this "slope" has the effect that, irrespective of the design of the outer surface, the outflow openings allow the quenching gas to be discharged in defined outflow directions. In addition to the described protuberances or depressions in the form of truncated pyramids, other shapes may also advantageously be used. Examples of favorable shapes are: the shape of a spherical cap 13*a,b*, of a truncated tetrahedron 14 or of a polygon 15 having another shape. In order to achieve a favorable dielectric configuration, the edges of the shape and the areas of the edges of the shape which are in contact with other surfaces are rounded off.

Figure 7:
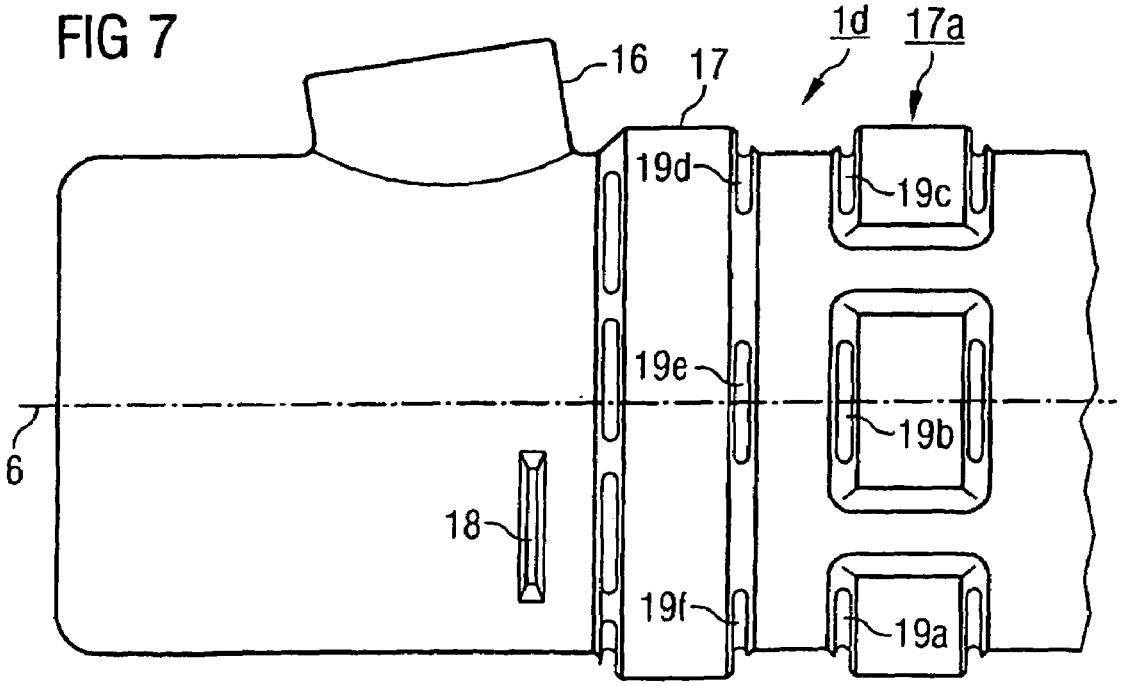
FIG. 7 shows the side view of a fourth embodiment of a flow-deflecting device.

The fourth variant illustrated in FIG. 7 of a flow-deflecting device 1*d* has, on its outer surface, a protuberance 17 which runs around the axial direction in the form of a ring and two or more protuberances which form a protuberance 17*a* which is in the form of a broken ring. Outflow openings 19*a,b,c,d,e,f* are arranged on the flanks of the protuberances 17, 17*a*. The outflow directions of the outflow openings 19*a,b,c,d,e,f* run in the axial direction, the outflow directions of the respectively associated outflow openings 19*a,f*; 19*b,e*; 19*c,d* intersecting one another. In modifications, depressions may be provided instead of the protuberances on the discharge device 1*d* for achieving the same effect, or the outflow openings may be aligned obliquely with respect to the surrounding surface.

In order, in addition, to swirl the switching gas emerging from the outlet openings, it is possible to provide additional swirling bodies or baffle plates which influence the deflection of the quenching gas. By way of example, a swirling body 18 protruding into a flow of gas is illustrated in FIG. 7.

Irrespective of the individual variants of the flow-deflecting device, all of the described protuberances may also be provided in the form of corresponding depressions, and vice versa, and may be combined with swirling bodies or baffle plates.

What is claimed is:

1. A power breaker, comprising:

a contact piece which is configured to move in an axial direction and has a flow of quenching gas which, when the breaker is operating, moves in the axial direction and which is coaxially surrounded by a flow-deflecting device, which has a first and a second outflow opening in an outer surface for deflecting at least some of the flow of quenching gas in a first and in a second outflow direction, wherein some of the flow of quenching gas emerging from the first outflow opening is deflected towards some of the flow of quenching gas emerging from the second outflow opening, and the flows of quenching gas intersect one another.

2. The power breaker as claimed in claim 1, wherein the flow-deflecting device has a protuberance and/or a depression on the outer surface, the first and/or the second outflow openings being arranged on flanks of the protuberance and/or depression.

3. The power breaker as claimed in claim 2, wherein the protuberance and/or the depressions run around the axial direction in a form of a ring and/or in a form of a broken ring.

4. The power breaker as claimed in claim 2, wherein the protuberances and/or the depressions extend essentially in the axial direction in a manner of a web or channel.

5. The power breaker as claimed in claim 2, wherein the first and/or the second outflow directions are arranged perpendicular to the outer surface regions immediately surrounding the first and/or the second outflow openings.

6. The power breaker as claimed in claim 1, wherein the first and/or the second outflow directions are arranged perpendicular to the outer surface regions immediately surrounding the first and/or the second outflow openings.

7. The power breaker as claimed in claim 6, wherein the protuberances and/or the depressions run around the axial direction in a form of a ring and/or in a form of a broken ring.

8. The power breaker as claimed in claim 6, wherein the protuberances and/or the depressions extend essentially in the axial direction in a manner of a web or channel.

* * * * *